US007387601B2

(12) United States Patent
Beck et al.

(10) Patent No.: US 7,387,601 B2
(45) Date of Patent: Jun. 17, 2008

(54) DEVICES AND METHODS FOR DRAWING AT LEAST ONE WEB OF MATERIAL OR AT LEAST ONE WEB STRAND INTO A FOLDING APPARATUS

(75) Inventors: Peter Franz Beck, Karlstadt (DE); Manfred Wolfgang Hartmann, Elfershausen (DE); Mathias Alexander Metz, Mainstockheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 44 days.

(21) Appl. No.: 10/594,450

(22) PCT Filed: Mar. 16, 2005

(86) PCT No.: PCT/EP2005/051207

§ 371 (c)(1),
(2), (4) Date: Sep. 26, 2006

(87) PCT Pub. No.: WO2005/092614

PCT Pub. Date: Oct. 6, 2006

(65) Prior Publication Data

US 2007/0184959 A1 Aug. 9, 2007

(30) Foreign Application Priority Data

Mar. 26, 2004 (DE) ..... 10 2004 015 479
Jul. 7, 2004 (DE) ..... 10 2004 033 036

(51) Int. Cl.
*B31B 21/26* (2006.01)

(52) U.S. Cl. ..... 493/254; 493/460; 493/447; 493/404; 226/91

(58) Field of Classification Search ..... 493/254, 493/460, 374, 379, 210, 446, 447, 404, 416; 156/196, 199, 200, 204, 221, 222, 226, 227, 156/443, 459, 547, 549, 461, 467; 270/5.01, 270/6, 7; 226/91, 92
See application file for complete search history.

(56) References Cited

U.S. PATENT DOCUMENTS 3,125,335 A 3/1964 Becker
3,544,454 A 12/1970 Muth et al.

(Continued)

FOREIGN PATENT DOCUMENTS

DE 1 611 283 2/1972

(Continued)

*Primary Examiner*—Hemant M. Desai
(74) *Attorney, Agent, or Firm*—Jones, Tullar & Cooper, PC

(57) ABSTRACT

A device is provided which is usable to draw at least one web of material or at least one web strand, that includes several webs of material, into a folding apparatus. The folding apparatus includes at least an upper structure, at least one folding funnel and a cross cutting device for separating the web of material, which has been transported in the upper structure and folded on the folding funnel, into individual products. At least one guide rail is provided. A holding part with a guiding end of at least one web of material fixed thereto, is displaceably guided on a path of web travel of the web through the upper structure. At least one guide rail is provided along the folding funnel.

49 Claims, 8 Drawing Sheets

U.S. PATENT DOCUMENTS

| | | | | |
|---|---|---|---|---|
| 4,819,557 | A | 4/1989 | Handschuher | |
| 5,052,295 | A | 10/1991 | Suzuki et al. | |
| 5,263,414 | A | 11/1993 | Lehrrieder et al. | |
| 5,312,488 | A | 5/1994 | Bolza-Schunemann et al. | |
| 5,461,851 | A | 10/1995 | Lehrieder et al. | |
| 5,699,735 | A * | 12/1997 | Stein et al. | 101/219 |
| 6,269,751 | B1 * | 8/2001 | Hauck et al. | 104/106 |
| 6,705,499 | B1 | 3/2004 | Ruckmann et al. | |
| 6,821,240 | B1 | 11/2004 | Ruckmann et al. | |
| 6,929,710 | B1 | 8/2005 | Ruckmann et al. | |
| 7,066,368 | B1 | 6/2006 | Ruckmann et al. | |

FOREIGN PATENT DOCUMENTS

| | | | |
|---|---|---|---|
| DE | 42 10 190 | | 9/1993 |
| DE | 101 28 821 | A1 | 1/2003 |
| DE | 101 28 821 | B4 | 1/2003 |
| EP | 0 302 256 | A2 | 2/1989 |
| EP | 0 302 256 | A3 | 2/1989 |
| EP | 0 418 903 | A2 | 3/1991 |
| EP | 0 418 903 | A3 | 3/1991 |
| EP | 0 553 740 | A1 | 8/1993 |
| EP | 0 477 769 | | 7/1995 |
| EP | 0 553 740 | B1 | 7/1996 |
| EP | 0 979 170 | | 4/1998 |
| EP | 1 334 940 | A1 | 8/2003 |
| EP | 1 169 252 | A1 | 2/2004 |
| EP | 1 169 252 | B1 | 2/2004 |
| WO | WO 00/56652 | | 9/2000 |

* cited by examiner

DEVICES AND METHODS FOR DRAWING AT LEAST ONE WEB OF MATERIAL OR AT LEAST ONE WEB STRAND INTO A FOLDING APPARATUS

CROSS-REFERENCE TO RELATED APPLICATIONS

This patent application is the U.S. national phase, under 35 USC 371, of PCT/EP2005/051207, filed Mar. 16, 2005; published as WO 2005/092614 A2 and A3 on Oct. 6, 2005 and claiming priority to DE 10 2004 015 479.1, filed Mar. 26, 2004, and to DE 10 2004 033 036.0, filed Jul. 7, 2004, the disclosures of which are expressly incorporated herein by reference.

FIELD OF THE INVENTION

The present invention is directed to devices and to methods for drawing in at least one web of material, or at least one continuous web, into a folding apparatus. At least one guide rail and on which a web leading end holding device travels, is provided. The holding device is displaceably guided through the superstructure of the folding apparatus along a route of web travel.

BACKGROUND OF THE INVENTION

A folding apparatus is known from WO 00/56652 A1. This folding apparatus is comprised of a superstructure, in which paper webs, which are fed in from one or from several printing groups, are brought together, perhaps after having been longitudinally cut and are placed on top of each other. The folding apparatus also consists of at least one former, in which a continuous strand of one web or of several brought-together paper webs is longitudinally folded in the superstructure. A transverse cutting device, in which the longitudinally folded web is cut into individual products, is also provided in the folding apparatus. Often, the transverse cutting device is realized by the provision of a rotating cutter cylinder, whose cutters work together with a thrust element on a gripper or folding blade cylinder, for severing the continuous web. The grippers of this gripper or folding blade cylinder maintain the products, which have been cut apart by the transverse cutting device, fixed to the surface of the cylinder and convey them to a transfer gap between the folding blade cylinder and a folding jaw cylinder. A folding blade then extends out of the folding blade cylinder to introduce the product held on the folding blade cylinder along a center transverse line into a folding jaw of the folding jaw cylinder and to fold it transversely in this way.

To draw a paper web, for the first time, into a printing press, it is known, from EP 0 553 740 B1, to use a holding element in the form of a rail-guided chain link element. A leading edge of the web, which is to be drawn in, and which has been torn off obliquely, is fastened to this chain link element. The guide rail extends next to the intended path of the web through the printing press as far as the superstructure of a folding apparatus.

The web is taken over by a draw-in device which is in the form of two spike-covered belts, as is described in connection with the already mentioned WO 00/56652 A1. The spikes of the belt spear the web along its lateral edges and pull it over an insertion roller at the upper edge of the former, as well as over the former itself.

Since pulling elements, which are independent of the guide rail and of the holding element conducted on it, are provided on the former, it is accomplished that, in accordance with the respective width of the webs to be processed, the former can be displaced in such a way that a web, which was folded on the former, enters the transverse cutting device exactly in the center. This is of importance for an interference-free functioning of the transverse cutting device, and, in particular, for the proper functioning of a downstream-connected transverse folding device.

DE 42 10 190 A1 discloses a cutting device with an integrated shunt. This device is arranged between draw-in rollers and folding cylinders.

DE 101 28 821 shows a device for bringing paper webs together in the course of their being drawn in.

U.S. Pat. No. 3,125,335 discloses a device for drawing in webs of material by the use of of belts.

EP 0 418 903 A2 describes devices which can be used for drawing in a plurality of web into a rotary web-fed printing press. Tapes that draw in the webs extend from the roll changers to the front of the formers.

A device for producing cut items is known from DE 1 611 283A. Two cutting cylinders are arranged one behind the other.

SUMMARY OF THE INVENTION

The object of the present invention is directed to providing devices and methods for drawing at least one web of material, or at least one continuous web, into a folding apparatus.

In accordance with the present invention, this object is attained by the provision of the folding apparatus with a superstructure, at least one former and a transverse cutting device. At least one guide rail is conducted along the former and has a curved section between a paper waste clipping device and an inlet of the transverse cutting device. The guide rail extends past the inlet of the transverse cutting device. The guide rail can extend from a roll changer into the former and can extend past the transverse cutting device. A plurality of guide elements can be provided.

The guide rail that is leading along the former can conduct the continuous web at least as far as directly to the transverse cutting device. On the far side of the transverse cutting device, such aids for the automated draw-in of the continuous web are no longer needed since no continuous web exists there anymore. Only individual products are present after the transverse cutting device.

To assure a matching orientation of the holding elements, with respect to the web of material held on it in, in the course of the passage of the web over the former, the guide rail is preferably twisted at the level of the former, preferably by approximately 90°.

To be able to adapt a former to the processing of continuous webs of various widths and to guide these various widths of webs, centered through the transverse cutting device and the transverse folding device, the former can preferably be shifted parallel with respect to the longitudinal axis of the transverse cutting device. So that the guide rail can follow such a shifting movement of the former, a section of the guide rail, which is located upstream of the former, in the running direction of the continuous web, should be stretchable or extendable.

In order to assure the precise feeding of the continuous web to the transverse cutting device, independently of the respective shifting of the former, an articulated section in the guide rail should be provided between the inlet of the former and the transverse cutting device.

The articulated section can be provided in a simple manner by the provision of one or of several cuts in the guide rail. This, in particular, permits a one-piece configuration of the guide rail over the articulated section.

The guide rail preferably has a groove, and in particular has a longitudinal groove, with a bottom and with two lateral walls, and in which groove the holding element is guided. The cuts sever one of the lateral walls and the bottom, respectively. The remaining uncut lateral wall can be bent comparatively easily.

In accordance with a first preferred embodiment of the present invention, the guide rail is extended past the transverse cutting device. A continuous web can be pulled through the transverse cutting device with the aid of a holding element which is guided by the guide rail. In that case, the transverse cutting device must be in an open position during the draw-in of all of the webs of material of the continuous web or strand. Only after the webs of material have been completely drawn in, can the transverse cutting device be put into operation to cut off the white paper waste, which constitutes the leading section of the continuous web.

It is alternatively possible, in accordance with the present invention, to provide a clipping device for use in severing the white paper waste, located at the front of the web, from the remainder of continuous web. An inlet of the transverse cutting device is arranged in an extension of the direction of the passage of the continuous web, which is provided by the clipping device. Following the severing of the white paper waste, the usable portion of the continuous web enters the transverse cutting device without requiring guidance by the guide rail.

To make such an introduction of the now clipped continuous web into the transverse cutting device simple and dependable, the inlet of the latter is preferably arranged vertically underneath the clipping device. The tip or start of the web of the usable portion of the continuous web is guided by gravity into the inlet of the transverse cutting device.

In this preferred embodiment of the folding apparatus in accordance with the present invention, the guide rail preferably has a bend located between the clipping device and the inlet of the transverse cutting device and runs past the inlet of the transverse cutting device. This construction of the guide rail makes it possible to let the transverse cutting device, and the portions of the folding apparatus following it, to start up simultaneously with the starting up of the upstream portions of the folding apparatus or of the entire printing press. This can be done even before the webs of material to be drawn in have reached the transverse cutting device. The time between the start of the draw-in process and the reaching of steady state operating conditions is shortened. Therefore, the amount of start-up waste is reduced.

A storage device for use in receiving holding elements, is arranged in an extension of the guide rail on the down stream side of the former. This allows the rapid draw-in of several webs of material, one after the other, during the draw-in process, without it being necessary for the holding element of a first web or strand of material to be moved back to its initial point in order to free the guide rail for facilitating the passage of the holding element of a further web or strand of material.

In a particularly space-saving manner, the storage device in accordance with the present invention can be constituted by a spherically-shaped or a helically-shaped rail element. This storage device is capable of receiving one holding element or several holding elements one behind the other and does not require the use of a large amount of space.

A separating device, for use in separating the holding elements from their respective webs of material, is appropriately provided upstream of the storage element. The leading sections of the webs of material, which are carried along by the holding elements, need not also be received in the storage device.

If the guide rail is bent past the inlet of the transverse cutting device, the separating device for separating the holding elements from the webs is suitably arranged on the guide rail between the bend and the storage device.

A guide rail can extend continuously from a roll changer of a printing group, which is situated upstream of the folding apparatus, as far as into the folding apparatus.

In order to be able to process several webs of material in a bundle, the superstructure of the folding apparatus preferably has several routes, on each of which routes respectively at least one web of material can be conducted through the superstructure and to the transverse cutting device. The several rail elements which extend along each of these routes are united with the guide rail upstream of the transverse cutting device.

To correctly guide the holding elements of the several webs of material at the junctions, and in particular if the holding elements are being returned after the webs of material have been drawn in, a shunt is preferably arranged at each of the respective junction points of the rail elements.

A glue-preparation device is preferably arranged upstream of a junction, on at least one of the routes. Such a glue-preparation device is used to make a continuous web, passing the glue-preparation device, locally sticky, so that the now sticky web portion adheres to a second, already drawn in continuous web at the junction.

The glue-preparation device can be an adhesive tape dispenser for use in dispensing a two-sided adhesive tape. Alternatively, it can be a glue dispenser.

In order to activate the glue-preparation device at the right time, a sensor, which is usable for detecting the gripping of the start of a passing web, is preferably assigned to the glue-preparation device.

The drawing-in of webs of material into a folding apparatus as described above preferably comprises the following steps:

- a first web of material is conducted along the guide rail to a location where one of the rail elements joins the guide rail,
- a second web of material is conducted on the rail element to this location and is fastened to the first web of material,
- the webs of material, which are now fastened to each other, are conducted further along the guide rail and are introduced into the transverse cutting device.

In this connection, it should be specifically noted that it is not necessary to stop a web of material between these various steps. Instead, all of the webs of material are preferably continuously moved from the start of the draw-in procedure until they reach the transverse cutting device.

The draw-in of the various webs of material is preferably synchronized in such a way that the second web of material is guided to the junction only after the holding element of the first web of material has gone past this location. Therefore, the first web of material holding element does not hamper the movement of the holding element of the second web of material.

A draw-in method is also within the scope of the present invention in which a first web of material is initially conducted on the guide rail to a location at which one of the rail elements joins the guide rail. Once the holding element has gone past this location, a second web of material is conducted to this location and from there is conducted along the guide rail on to the transverse cutting device.

The webs of material can be conducted through the transverse cutting device. The transverse cutting device remains at rest until all of the webs of material have been pulled through it, so that no holding element is damaged by operation of the transverse cutting device. In an alternate embodiment, it is possible for the webs of material to be conducted through a clipping device that is located upstream of the transverse cutting device and then past the transverse cutting device with the aid of the guide rail. The clipping device is activated only after all of the tips, which are grasped by the holding elements, have moved past the clipping device in order to clip the continuous web of material and to permit the leading edge, which is being formed in the course of such clipping, to enter the transverse cutting device.

If the transverse cutting device is also moved along in the correct phase during the draw-in procedure, it can correctly separate the continuous web or strand into products the moment the web or strand begins to enter the transverse cutting device.

To further shorten the start-up process of the folding apparatus, or of a printing press containing the folding apparatus, and to reduce the amount of start-up waste, a pair of draw-in rollers of the printing press or of the folding apparatus are preferably initially disengaged. However, as soon as the passage of the leading edge of the web of material or of the continuous material through the pair of draw-in rollers is detected. The pair of draw-in rollers are brought into engagement and are driven in a controlled manner. A tractive force, which is exerted by the pair of draw-in rollers, approaches a desired value which is provided for continuous printing operations.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
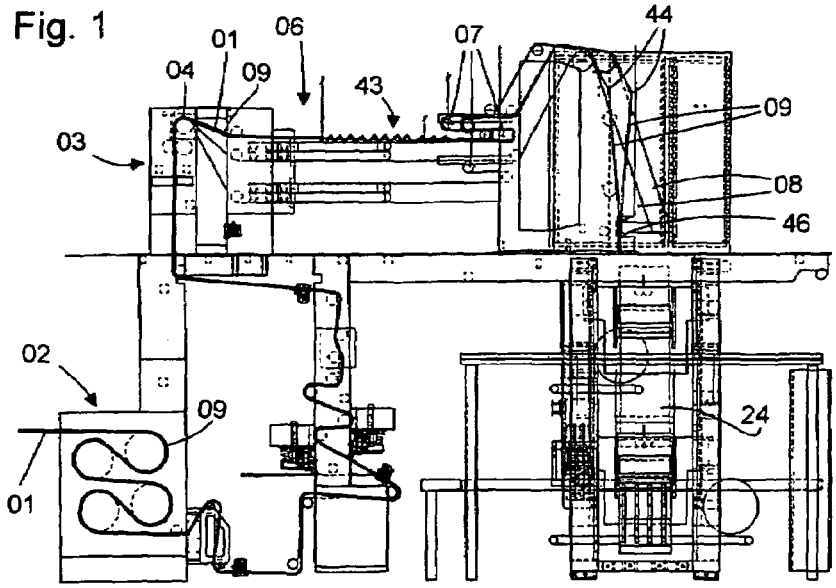
FIG. 1, a schematic side elevation view of a device for draw-in of at least one web of material, in FIG. 2, a detailed perspective view of a guide rail and of a holding element guided in the guide rail for a web of material to be drawn-in, in FIG. 3, a detailed side elevation view of the device in accordance with the present invention, taken in the perspective of FIG. 1, in FIG. 4, a detailed view of an inlet area of a former, in FIG. 5, a partial front elevation view of the device for drawing in at least one web in accordance with the present invention, in FIG. 6, a partial front view of a superstructure with two formers arranged side-by-side, side, in FIG. 7, a modification of a portion of the device depicted in FIG. 5, in FIG. 8, a detailed side elevation view, analogous to FIG. 3, of the folding apparatus in the course of processing continuous webs of reduced width in accordance with the present invention, in FIG. 9, a detailed view of a guide rail at a level of an outlet area of a former, in FIG. 10, a cross section of a guide rail, in FIG. 11, a preferred embodiment of a device in accordance with the present invention during draw-in, and in FIG. 12, an advantageous embodiment of a chain for use in the present invention.

A schematic side elevation view of a folding apparatus, in accordance with the present invention, is shown in FIG. 1. A web 01 of material, which is coming from a printing group, that is not specifically represented, such as, for example, a paper web 01, passes through a cooling roller stand 02 and arrives at a superstructure 03 of the folding apparatus. The superstructure 03 is comprised of at least one longitudinal cutter 04 for use in separating the incoming paper web 01 into a plurality of side-by-side located partial webs. A turning deck 06 is also provided, and in which the now side-by-side partial webs of the paper web 01, and possibly further paper webs, which are not specifically represented, are rearranged, are shifted and/or turned transversely to the running direction, which is from the left to the right in FIG. 1 and are then placed on top of each other. From the turning deck 06, the path of the paper web 01 extends to a former 08, through an intermediate arrangement of compensation rollers 07, which are utilized for compensating for the web length and for drawing control.

The former 08 and the compensation rollers 07 are movable in a lateral direction in FIG. 1. To do so, they are situated in a common frame and, for the sake of clarity, are represented twice in FIG. 1 in two positions in which they are shifted with respect to each other.

Starting at an outlet of the former 08, the paper web 01 now runs downward through a transverse cutting device 24 and through a transverse folding device which has a construction that is generally known, and which thus need not be explained in greater detail here. A guide rail 09, which is represented in FIG. 1 as a heavy black line, extends along the path of travel of the paper web 01. The guide rail 09 is represented, starting at its entry into the cooling roller stand 02, and continuing as far as the lower end of the former 08. The guide rail 09 preferably extends without interruption from the roll changer of a printing group, which is not specifically represented in FIG. 1, and which is located upstream of or before, in the direction of travel of the web 01, the folding apparatus, as far as the former 08 and beyond.

Figure 2:
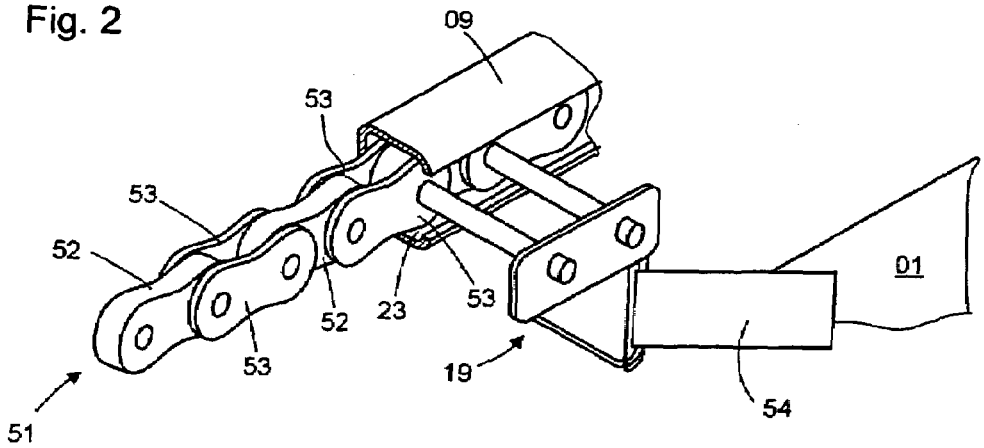

The guide rail 09 may have a U-shaped or, as represented in FIG. 2, may have a C-shaped cross section which defines a groove 23. In groove or channel 23, which, in particular is a linear groove 23, a chain element 51 is guided. The chain element 51 is constructed of alternating single-or double-segmented links 52, 53, at least one of which links has an arm 19 which projects out of the groove 23. As depicted in FIG. 2, two adjoining links 53 together support an arm 19. The chain element 51 and the arm 19 will also be referred to as a holding element 51, 19 in the discussion which follows. A hook is provided at an outer end of the arm 19. This hook is provided for fastening to the leading edge 54 of a paper web 01 to be freshly drawn in, or for engaging a draw-in tip that is connected with the leading edge 54 of paper web 01, with the aid of a loop placed around it.

The single-segmented links 52 of the chain element 51 are elastic in themselves. For example, they may be made in one piece of an elastic material, or they may have an elastic center element, which is not specifically represented in FIG. 2, and which may be made of spring steel or the like. In this way, the twisting of the chain element 51, around an axis extending parallel with the longitudinal direction of the guide rail 09, and the bending of the chain element 51 around an axis which is perpendicular, with respect to a plane of the paper web 01 is made possible.

Motors, which are not specifically represented are attached at regular intervals to the guide rail 09. Each of these motors supports a chain wheel which engages the chain element 51 through a gap in the side of the guide rail 09 in its groove 23, and specifically between the links 52, 53. The length of the chain element 51 is selected to be slightly greater than the distance between two successive chain wheels along the guide rail 09. It is thereby assured that, in the course of conveying the chain element 51 along the guide rail 09, at least one chain wheel is always in engagement with the chain element 51 and drives it. To draw in a paper web 01, it is therefore sufficient to fasten the leading edge 54 of the paper web 01 on the respective arm 19 of a chain element 51, which arm 19 is projecting from the groove 23, and to then put the chain element 51 into motion along the guide rail 09 in order to draw in the paper web 01.

Figures 3, 8:
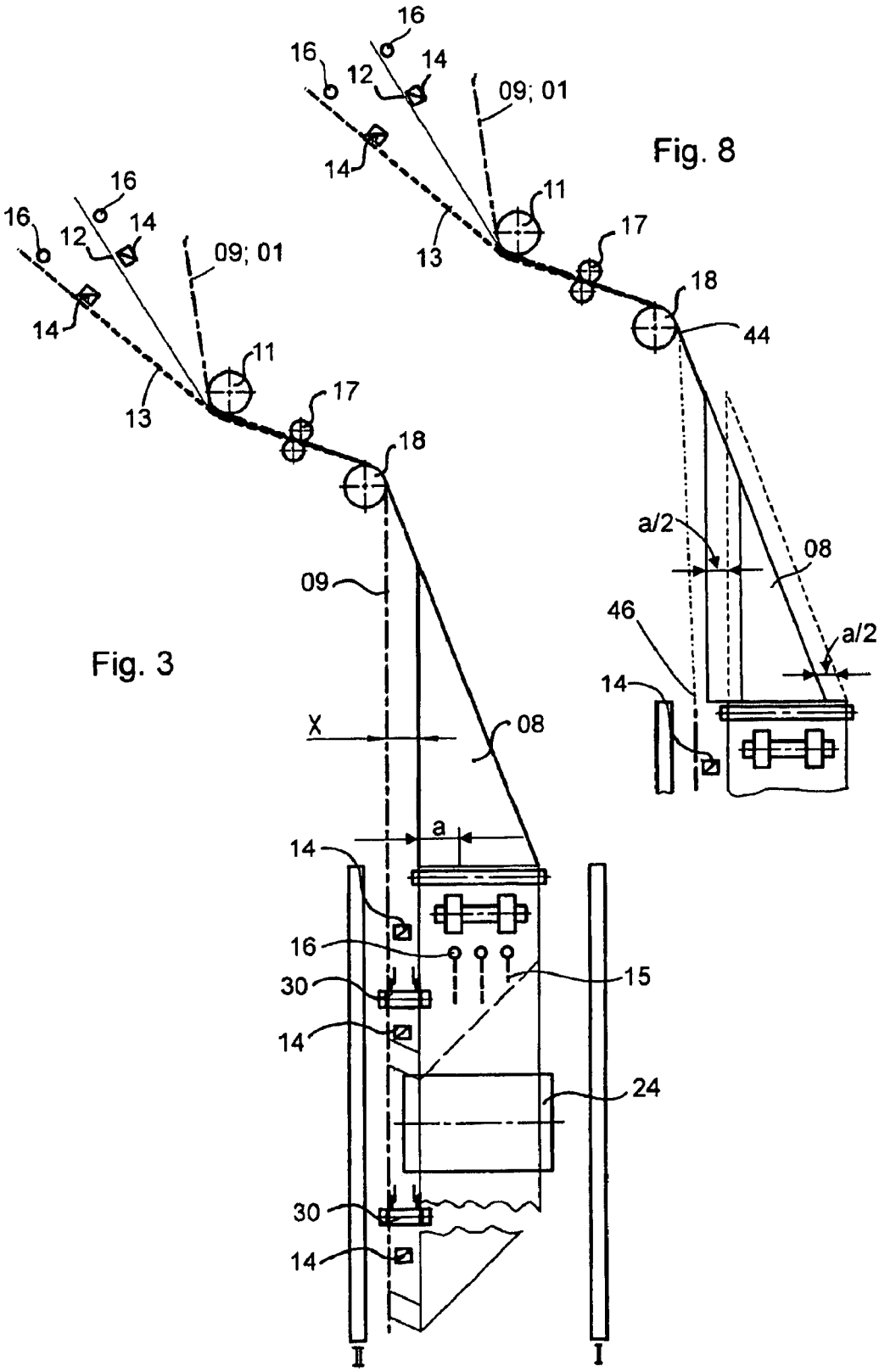

In an enlarged representation of a portion of FIG. 1, FIG. 3 shows the former 08 and its surroundings from the same perspective as it is depicted in FIG. 1. In FIG. 3, the course of the guide rail 09, or of a paper web 01 which drawn in by guide rail 09, has been depicted as a dash-dotted line. Two further rail elements 12, 13, represented as a dotted or an evenly dashed line, join the guide rail 09 at a junction roller 11. A sensor 14, such as, for example, a photo-cell 14, which is usable for detecting the presence of a draw-in paper web 01, is located on, or adjacent each one of the further rail elements 12, 13 shortly ahead, or before in the direction of web travel, of the junction point with the guide rail 09. A glue-preparation device 16 for use in applying an adhesive 15 to each of the webs 01 drawn along the further guide rails or elements 12, 13, is located before or upstream of each sensor 14, as seen in FIG. 3. The glue-preparation device 16 can be utilized for applying a strip of a liquid adhesive to the leading section of a paper web 01 which is conducted past it along the rail element 12 or 13. A possible construction of such a device is described, for example, in EP 0 477 769 B1. An adhesive tape dispenser could alternatively also be considered for use as a glue-preparation device 16 which adhesive tape dispenser is shifted, as soon as the photo-cell 14 indicates the arrival of the paper web 01, in the direction of the width of the paper web 01 and is operable for rolling off a strip of double-sided adhesive tape on the paper web 01.

The glue-preparation device 16 can also consist of a plurality of spray nozzles for dispensing a spray adhesive. These nozzles are distributed over the width of the paper web 01. A photo-cell 14 is assigned to each such spray nozzle to cause one of the adhesive spray nozzles to spray a dose of adhesive onto the paper web 01 at the moment when the leading edge of a paper web 01 moves past one of the adhesive spray nozzles. This can be seen in particular in FIG. 5 with the spray nozzles of the glue-preparation device 16 being located above the former 08.

The time at which a paper web 01, which is being conducted along the further rail element 12, arrives at the junction roller 11 has been selected so that at this time, a chain element 51, which has already drawn in the paper web 01 and which runs along the guide rail 09, 13, has moved past the junction roller 11. The chain element 51, which is coming from the further rail element 12, can then be changed onto, or switched onto the guide rail 09, and can be further conveyed on it.

As soon as a first chain element 51, with its first paper web 01, has completely moved past the junction roller 11, a further, or second, paper web 01 can be fed, in a corresponding manner, via the rail element 09, 13 and can be glued to the first paper webs 01, which is already running over the junction roller 11.

The continuous web or web strand that is obtained in this way, moves past a separating device 17, such as, for example, a hopper separating device 17 having a rotating cutter and a counter-support roller. Such a separating device 17 is used to sever the connection between the arm 19 of the draw-in chain 51 and the tip 54 of the paper web 01, which is no longer needed at this place. The hopper separating device 17 is used on all of the paper webs passing through it, whose leading ends have already been glued to a paper web 01 which has been drawn in farther than they are. In particular, the hopper separating device 17 is used with paper webs 01 fed in via the further rail elements 12, 13.

Figure 4:
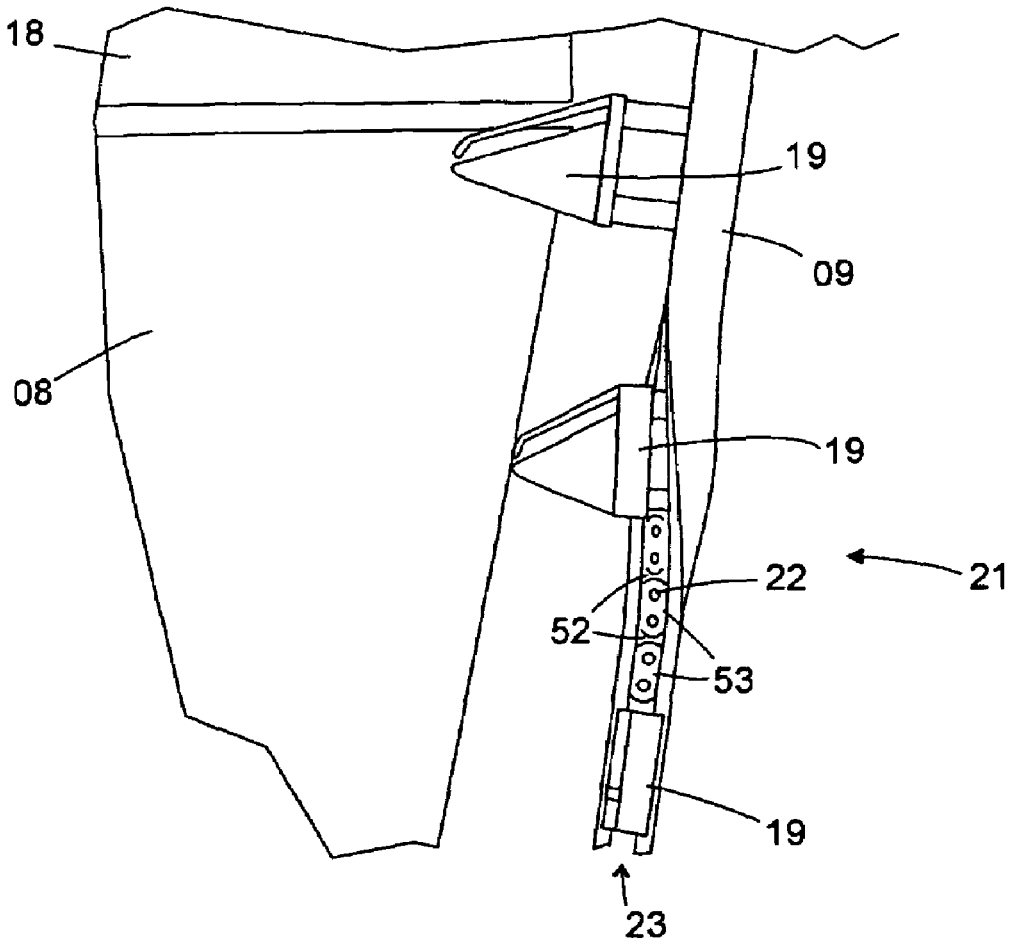

The direction of travel the continuous web or web strand 01 is again changed at a former inlet roller 18 and arrives on the sloping surface of the former 08, which sloping surface tapers downward. As the continuous web or web strand 01 is drawn over the lateral edges of the former 08, its orientation changes from an orientation upstream of the former inlet roller 18, which is a substantially perpendicular orientation, in respect to the plane of FIG. 3, to an orientation, after the former 08, which is substantially parallel with respect to the plane of FIG. 3. In order for the guide rail 09 to be able to conduct the paper web 01 through this change in orientation, the guide rail 09 is twisted by 90° in a section 21 that is subsequent to, or following the hopper inlet roller 18, as represented in FIG. 4. This change in orientation of the guide rail 09 is depicted in FIG. 4 as being shortened in the longitudinal direction of the guide rail 09 for reasons of improved representation. To make the orientation easier to understand, a portion of the former inlet roller 18 and of the former 08 have been represented. An axis of the former inlet roller 18 is aligned parallel with the plane of FIG. 4. Following its passage over the former inlet roller 18, the groove 23 of the guide rail 09 at first still faces the former inlet roller 18, and the arm 19 of a holding element protrudes out of the groove 23 in the direction toward the former inlet roller 18. In the twisted section 21 of the guide rail 09, the groove 23 now turns or rotates slowly forward, in the perspective of FIG. 4, and the pin 22 and links 52, 53 of the chain, which is enclosed in the groove 23, become visible. After the twisted section 21 of the guide rail 09 has been passed, the orientation of the chain element 51 is now rotated by 90°, and the arm 19 which the chain element 51 carries now protrudes perpendicularly, with respect to the plane of FIG. 4. It should be noted that the three successive arms 19 which are represented in FIG. 4 do not represent three arms 19 of the same chain element 51. Instead, FIG. 4 represents the same arm 19 in successive, different phases of the movement of the arm 19 along the guide rail 09. It has been accomplished by, the twisting or rotating of the guide rail 09, that the paper webs 01 are still accurately and positively guided even after passage of the paper webs 01 through the former 08.

Figure 5:
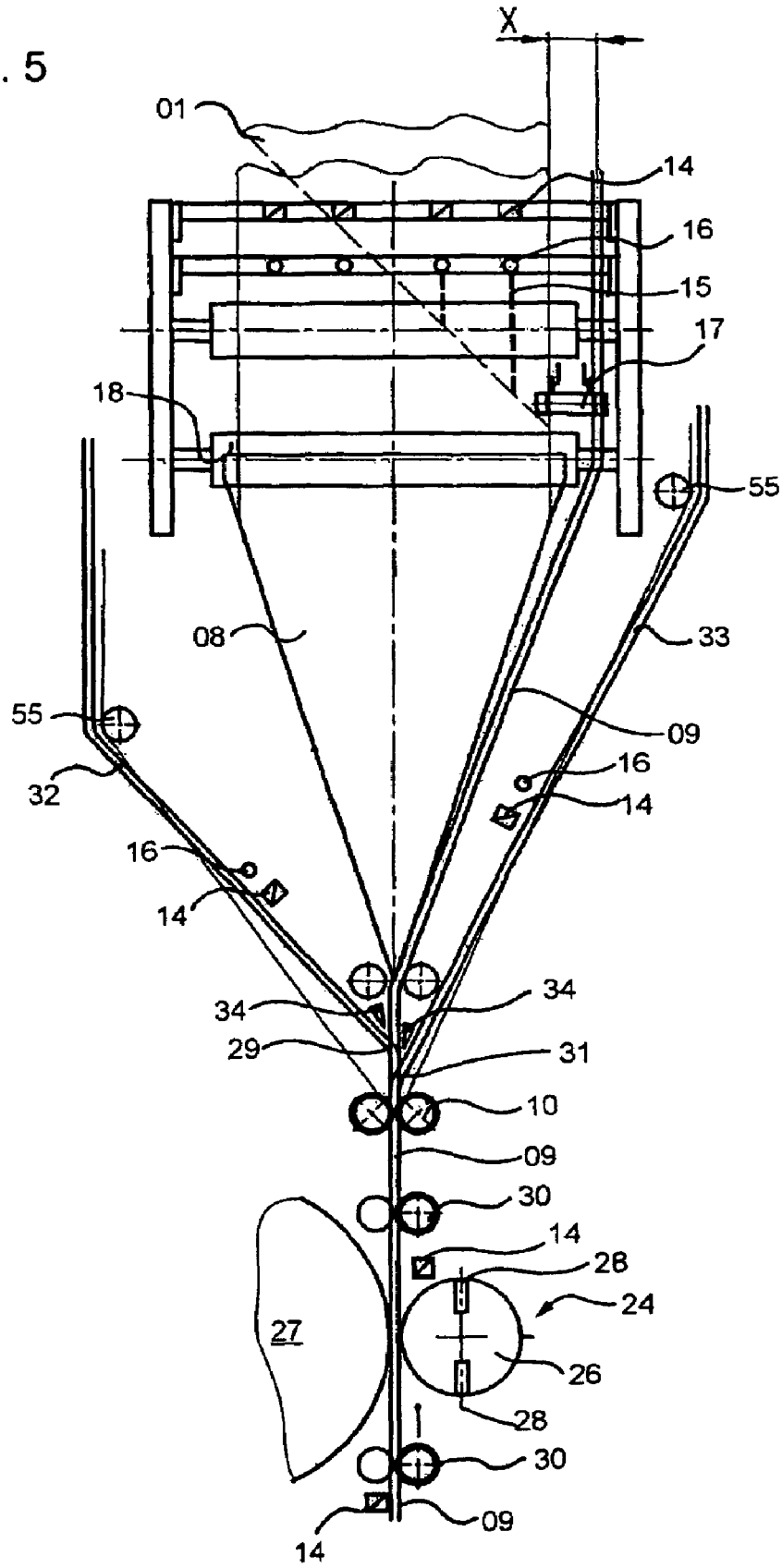

The further course, or direction, of the guide rail 09 can be better observed by referring to FIG. 5, which shows the same structure as is depicted in FIG. 8 but in a perspective turned by 900 from FIG. 8. From a lower tip of the former 08, the guide rail 09 extends vertically downward between feed rollers, which are moved away from each other during the web draw-in in order not to hamper the passage of an arm 19 carrying a web tip. The guide rail 09 is conducted past the cutting gap of a transverse cutting device 24 in such a way that the paper webs 01 are inserted into the cutting gap of this transverse cutting device 24. The transverse cutting device 24 is comprised of a cylinder 26, such as, for example, a cutter cylinder 26, and a cylinder 27, such as, for example, a gripper cylinder 27, and/or a folding blade cylinder 27, on which counter-supports, which are made of hard rubber, and which are not specifically represented, are arranged, which counter-supports work together with the cutters of the cutter cylinder 26 when the transverse cutting device 24 is in operation. Preferably, the cylinder 27 is embodied as a folding blade cylinder 27, and has holding elements, such as, for example, grippers or spur needles. The cylinders 26, 27 of the transverse cutting device 24 are shown, in FIG. 5, in the position while the paper webs 01 are being drawn in. The cutters 28 of the cutter cylinder 26 are substantially aligned in a line parallel with respect to the guide rail 09, so that a gap is open between the cylinder 26, 27, through which the paper webs 01 can be drawn.

Figure 12:
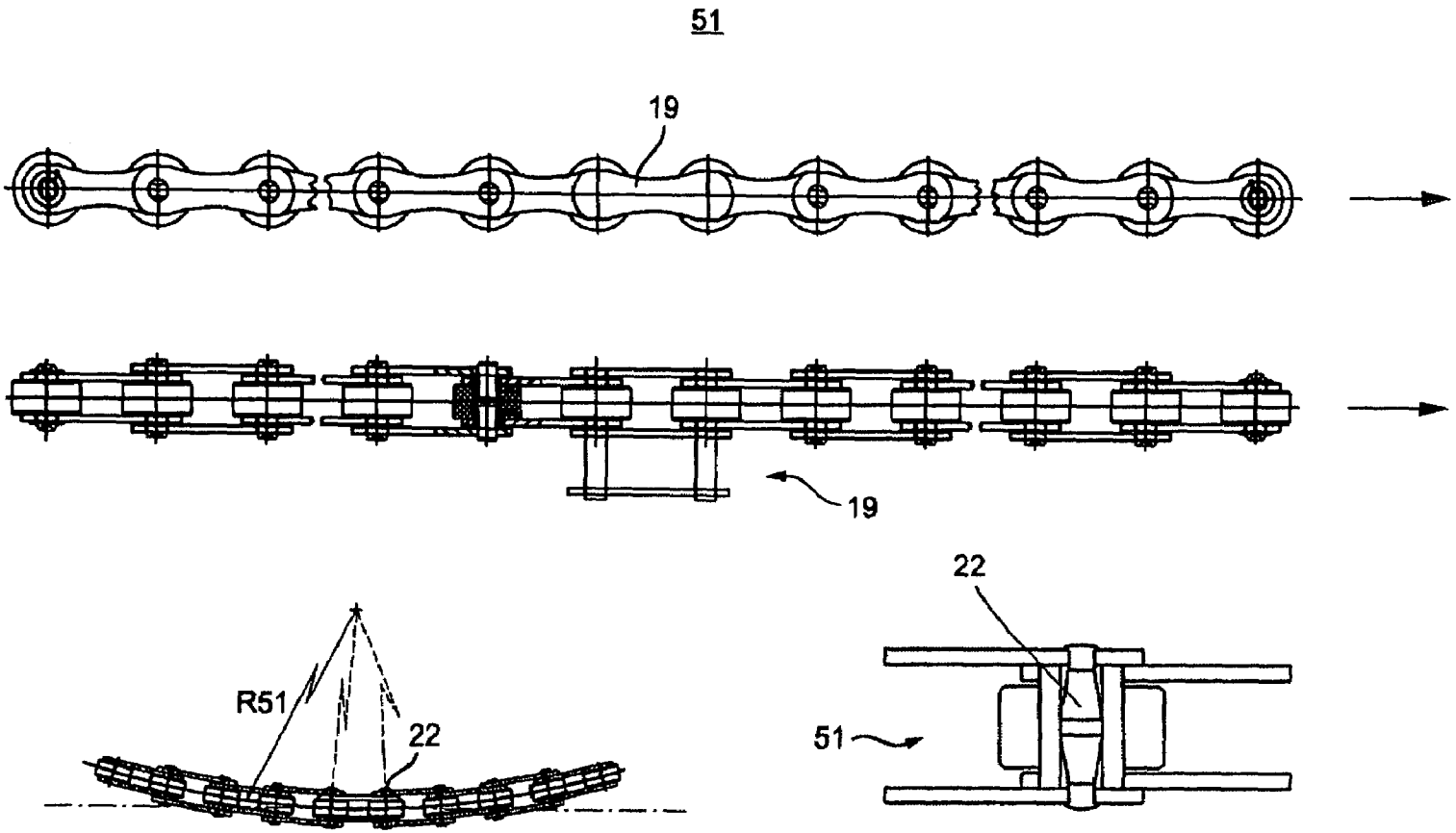

An advantageous embodiment of the chain element 51 is represented in FIG. 12. The chain 51 element has rollers seated on pins 22. The pins 22 are each connected, in a spaced-apart manner, by brackets. To insure that the chain 51 is not limited to only make a pivot movement around the longitudinal axis of the pins 22, bores in the brackets are, for example, made slightly larger than the diameter of the pins 22. The chain 51 can accordingly be curved transversely to the chain running direction, or to the orientation of the longitudinal axes of the pins 22. Therefore, a maximum radius of curvature R51 of 1000 mm, preferably of less than 600 mm, and particularly preferred of less than 500 mm, results in the curved state of the chain element 51, as depicted in FIG. 12.

It is also possible to embody the pin 22 with different diameters in its longitudinal direction, and in particular to make the pin 22 crowned, as is also shown in FIG. 12.

Two further junction points 29, 31 are shown in FIG. 5 between the lower tip of the former 08 and the inlet of the transverse cutting device 24. Each of these further junction points 29, 31 is where a respective further rail element 32, 33 meets the guide rail 09. These further rail elements 32, 33 are used for bringing in further continuous webs 01 which have, for example, passed through other formers, which are not specifically represented, of the folding apparatus. The further rail elements 32, 33 are also equipped with photocells 14 and with glue-preparation devices 16 for attaching these subsequently delivered continuous webs 01 to the webs or web strands which are conducted on the guide rail 09.

A separating device 30, which corresponds in form and function to the hopper separating device 17, and which may be, for example, a folding and separating device 30, is arranged on the guide rail 09. One such separating device 30 is located both shortly upstream, and shortly downstream of the transverse cutting device 24. The front or upstream folding and separating device 30 is used for separating the continuous webs or web strands 01 supplied via the further rail elements 32, 33 from their respective holding elements. The rear or downstream one of the folding and separating devices 30 separates the paper web 01, which has been drawn in first and which constitutes the tip of the continuous web or web strand 01 entering the transverse cutting device 24, from its holding element.

After all of the paper webs 01 have been drawn in through the transverse cutting device 24, the transverse cutting device 24 can be put into operation. The tips of all of paper webs 01 of the drawn-through continuous web or web strand 01 are cut off in the first cut of the transverse cutting device 24.

At a time which is no later than the time when all of the holding elements have been released from their respective paper webs 01, a start is made to pull them back to their respective original locations over the guide rail 09, or along the further rail elements 12, 13, 32, 33. To assure that exactly one holding element is returned to each original location, shunts 34 are provided at the respective junction locations. Settings of these shunts 3A are automatically controlled in order to return each holding element to its assigned original location.

Figure 6:
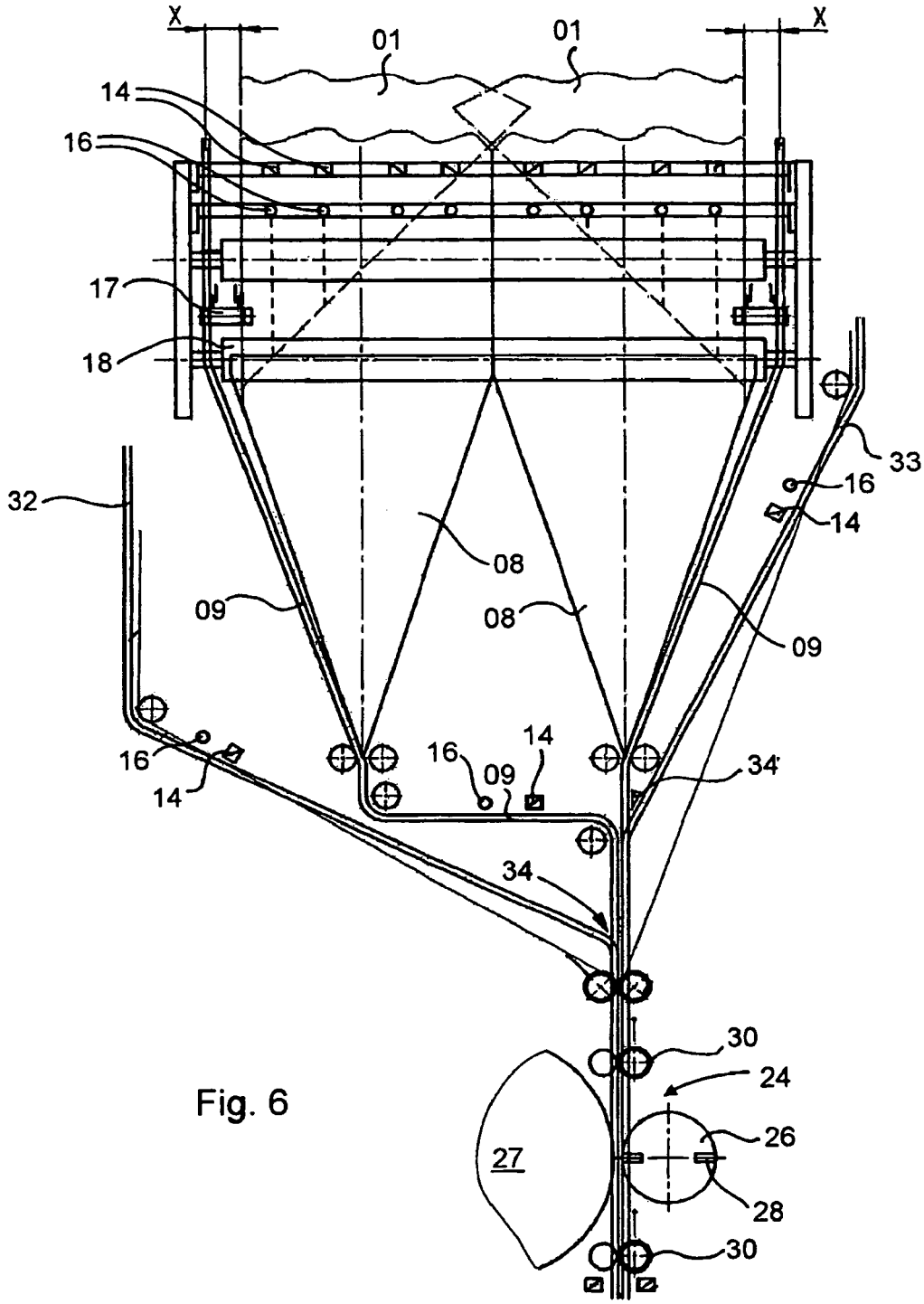

In a view which is analogous to FIG. 5, FIG. 6 shows an embodiment of the folding apparatus in accordance with the present invention with two side-by-side located formers 08 which are each usable for processing paper webs 01 each of a width of four pages. In this embodiment, each of the formers 08 is assigned its own guide rail 09 for use in conducting paper webs 01 through the transverse cutting device 24. It would also be possible, in principle, to unite the two primary guide rails 09 prior to their respective passage through the transverse cutting device 24. However, an advantage of the provision of two such parallel conducted guide rails 09 lies in that two holding elements can simultaneously pass through the transverse cutting device 24. The drawing in of paper webs 01 thus takes less time. Accordingly the total amount of paper which must be drawn through until the holding elements of all of the paper webs or web strands 01 have passed through the transverse cutting device 24 is considerably reduced.

Figure 7:
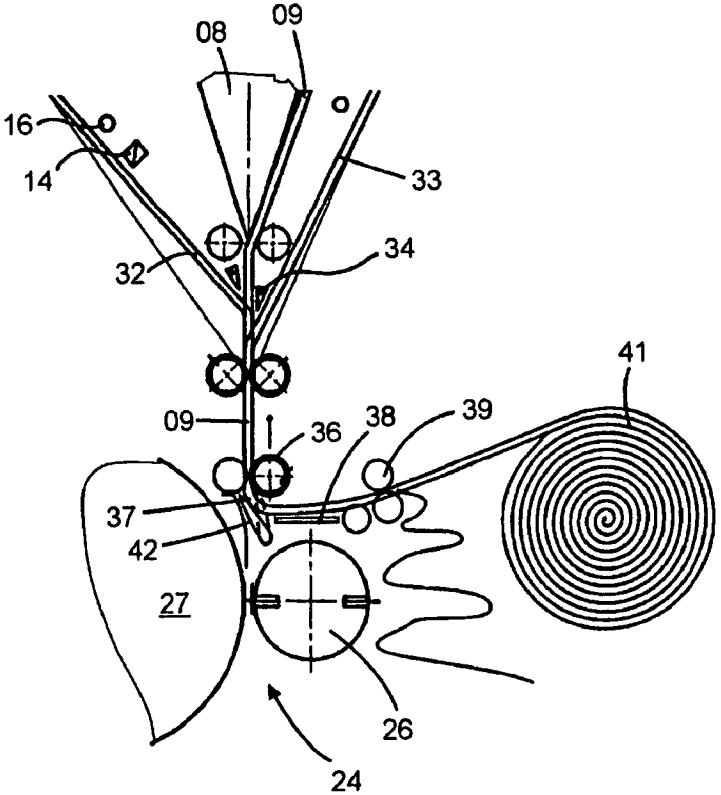
Figure 11:
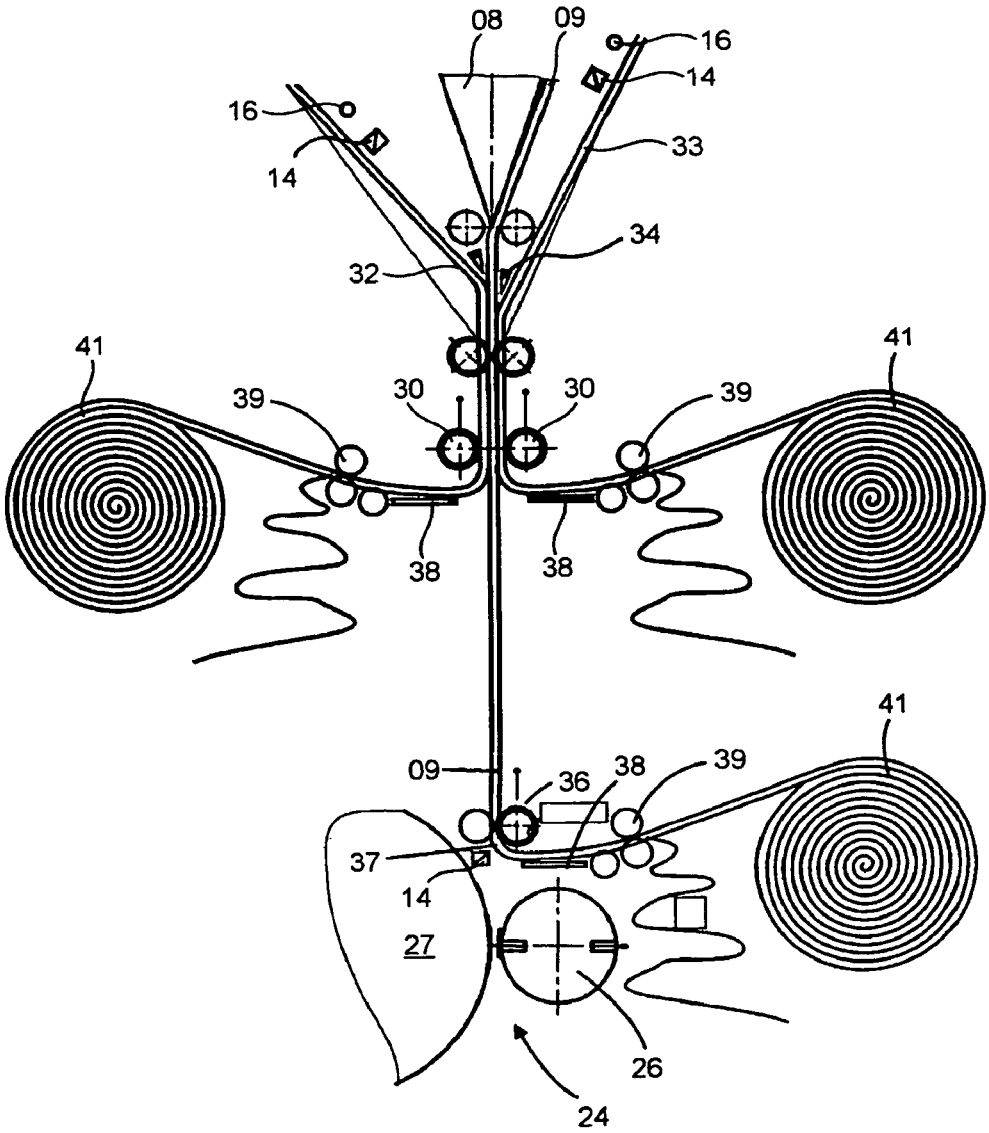

FIGS. 7 to 11 represent alternative embodiments of a course of the guide rail 09 at the inlet of the transverse cutting device 24 in accordance with the present invention. A clipping device 36, which is usable for clipping the drawn-through continuous web, is placed upstream of the inlet of the transverse cutting device 24. The guide rail 09 traverses the clipping device 36 in a vertical direction directly above an inlet nip of the transverse cutting device 24. The guide rail 09 has a curved section 37 which is located beneath, or underneath the clipping device 36. This guide rail curved section 37 extends above a guide panel 38, and in a lateral direction, to a separating device 39, which separating device 3 separates the head section of each passing paper web 01 from its holding element. The continuous web, which is now no longer being guided on the downstream side of the separating device 39, drops down freely and is ejected from the folding apparatus. The holding element is moved on the lateral section of the guide rail 09 into one or several storage devices 41, which are schematically represented in FIG. 7 as a spirally wound guide rail 09. An alternative space-saving embodiment of the storage device 41 is a helically bent guide rail, and preferably one with a longitudinal axis which is parallel with the shafts of the cylinder 26, 27.

With this embodiment of the present invention, as depicted in FIG. 7, the cylinders 26 27 of the transverse cutting device 24 can rotate synchronously in phase with draw-in rollers of the folding apparatus or with parts of the printing press which are located upstream of the transverse cutting device 24 before all of the paper webs 01 or web strands have been drawn in. As soon as this draw-in has occurred, the clipping device 36 cuts once through the continuous web or web strand 01. A shunt 42, which is arranged in the inlet nip of the transverse cutting device 24, simultaneously changes from its position shown in solid lines in FIG. 7, into a position which is shown in dashed lines in FIG. 7 in order to dependably introduce the freshly formed leading edge of the continuous web or web strand 01 into the transverse cutting device 24. Since the transverse cutting device 24 can run at a rotational speed which is matched to the conveyed speed of the continuous web or web strand 01 at the time it is clipped, the time which is needed for reaching the steady state printing conditions is reduced. Therefore, the amount of waste being generated in the course of the start-up of the printing press is also reduced.

In order to reduce this amount of paper waste even more, it is possible to provide sensors at pairs of draw-in rollers through which a paper web 01 runs on the way from the roll changer to the transverse cutting device 24 and which draw-in rollers are moved away from each other during the draw-in of the paper web 01. These sensors may be photocells 14 which are usable for detecting the presence of the paper web 01 which sensors 14, as soon as they detect the passage of a paper web 01 through the pair of draw-in rollers, cause the draw-in rollers to be placed against each other and to be driven to produce a predetermined tractive force on the respective paper web 01. In this way, it is possible, in the course of drawing in the paper web 01, to start with the matching of a tractive force exerted on the paper web 01 to values desired for steady state printing operations, by the use of which, the time required for reaching these steady state conditions is also shortened.

If it is intended to process several paper webs 01 of different widths in the folding apparatus, it is important, for the insurance of trouble-free operations, that these different width paper webs 01 all run through the center of the transverse cutting device 24 and the subsequent transverse folding device. The displaceability of the former 08, as previously mentioned in connection with FIG. 1, in a direction which is parallel with respect to the shafts of the cylinders 26, 27, or which is parallel to the cutting direction of the transverse cutting device 24, is required for this. A juxtaposition of FIGS. 3 and 8 makes this clear. In FIG. 3 the position of the former 08 is appropriate for a paper web 01 of the maximum width which can be processed in the folding apparatus. If, in the same position of the former 08, a web, which is narrower by a width 2*a*, were to be processed, a strip of the width "a" would remain unused at the left edge of the transverse cutting device 24, as seen in the perspective of FIG. 3, while the longitudinal fold would come to rest at the right edge of the transverse cutting device 24, the same as that of a paper web 01 of normal width. To correctly introduce such a narrow paper web 01 into the transverse cutting device 24 it is necessary, as shown in FIG. 8, to displace the frame which supports the former 08, the junction roller 11, the rail elements 12, 13 and the compensation rollers 07 toward the left over a distance a/2. To make this displacement or shifting possible, the guide rail 09 can be telescopically extended or shortened, or its length can otherwise be changed in another suitable manner, in an area 43, as seen in FIG. 1, between the turning deck 06 and the compensation rollers 07. The guide rail 09 may, for this purpose, be flexibly embodied in the manner of an articulated section 44, 46 in areas 44, 46 at the tip, or at the base of the former 08, in order to permit a smooth passage of the holding elements through the folding apparatus as far as the storage device 41 in any position which the former 08 can assume.

Figure 9:
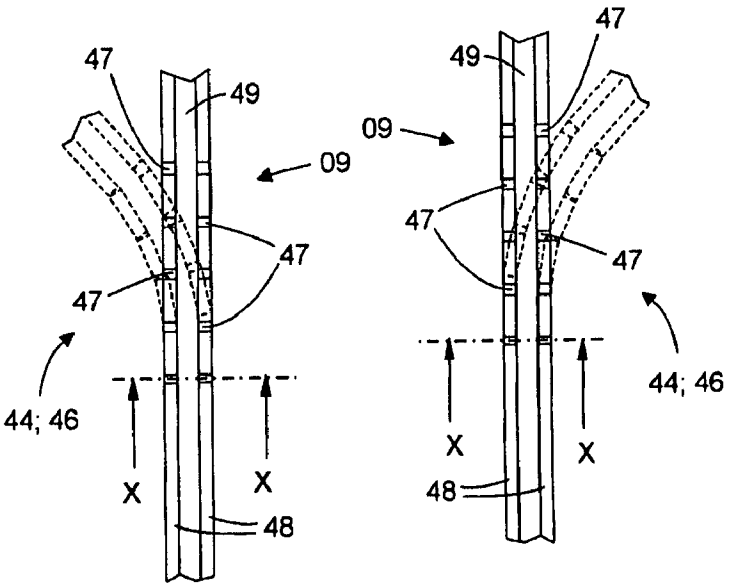
Figure 10:
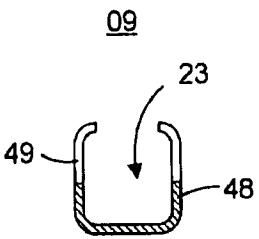

A preferred embodiment of such a flexible guide rail 09 in accordance with the present invention will be explained with the use of FIGS. 9 and 10. FIG. 9 shows a top plan view of a flexible section 44 or 46, and FIG. 10 depicts a cross-section taken through the guide rail 09 of FIG. 9 at the level of the line X-X in FIG. 9. The level of the cross-section of FIG. 10 has been placed through one of several cuts 47, which have been formed in the flexible area 44 or 46 alternating respectively from different sides of the guide rail 09 and which respectively cut through lateral walls 48 of the guide rail 09. The lateral wall 48, which is remaining at the level of the cuts 47, is considerably more flexible than the guide rail 09 which is not cut, and primarily permits controlled bending of the guide rail 09 in a plane without its simultaneous twisting.

A configuration of the guide rail 09, in which its section located above the flexible area 44, 46 is bent toward the left, is shown as a dotted outline in FIG. 9. Depending on their orientation, the cuts 47 are alternatingly narrowed or widened. In order to illustrate the principle of the guide rail bending, the width of the cuts 47 and the amount of bending have been exaggerated in FIG. 9. In actuality, the width of the cuts 47 and their deformation is not allowed to be so great that the smooth passage of the chain links through the groove 23 is endangered by these cuts 47 and the deformation of the guide rail 09. However, this requirement can be met without difficulties, because the required freedom of bending of the guide rail 09 is no more than a few degrees, and the widening of each of the individual cuts 47, in the course of bending of the guide rail 09, is less, the greater the number of the individual cuts 47 is.

In an advantageous embodiment of the present invention, and during the web draw-in process, a distance X of the guide rail 09 from the paper web 01, as seen in FIG. 3, and also over the entire folding structure, i.e. at least from the hopper folding roller 18 which conveys the not yet folded paper web 01 over the path of the formers 08 as far as to their tip, is maintained constant.

The draw-in process preferably takes place through the printing groups, which are assigned to the web path, while those printing groups are not in a print mode.

While preferred embodiments of devices and methods for drawing at least one web of material or at least one web strand into a folding apparatus, in accordance with the present invention, have been set forth fully and completely hereinabove, it will be apparent to one of skill in the art that various changes in, for example the specific structure of the printing press, the types of motors used, and the like could be made without departing from the true spirit and scope of the present invention which is accordingly to be limited only by the appended claims.

What is claimed is:

1. A web draw-in device comprising:

a web folding apparatus including a superstructure;

at least one former located in said web folding apparatus after, in a direction of paper web travel, said superstructure;

a transverse cutting device adapted to transversely cut webs of material transported in said superstructure and folded at said former, said transverse cutting device being located after, in said direction of web travel, said at least one former;

at least one guide rail adapted to receive paper web leading end holding devices and being usable to guide said paper web leading end holding devices along a route of travel of the webs of material in said web folding apparatus to draw in the webs of material through said web folding apparatus, said guide rail extending through said superstructure, past said former and, in said direction of web travel, to at least an inlet to said transverse cutting device; and at least one twisted guide rail section in said guide rail, said at least one twisted guide rail section in said guide rail being located adjacent said at least one former.

2. The device of claim 1 further including a plurality of guide elements joining said guide rail before, in said direction of web travel, said transverse cutting device and after said at least one former.

3. The device of claim 1 further including a paper web leading end clipping device before said transverse cutting device and further including a guide rail curved section after said clipping device and before said inlet to said transverse cutting device.

4. The device of claim 1 wherein said guide rail is displaceable in a cutting direction of said transverse cutting device.

5. The device of claim 1 further including an extendable guide rail section before, in said direction of web travel, said former, said guide rail being extendable in said direction of web travel.

6. The device of claim 1 wherein said guide rail has an articulated section between an inlet to said former and said transverse cutting device.

7. The device of claim 6 further including a plurality of cuts in said guide rail and forming said articulated section of said guide rail.

8. The device of claim 7 wherein said guide rail includes a bottom and spaced side walls defining a groove in which said holding devices are guided, said cuts extending through at least one of said side walls.

9. The device of claim 1 wherein a spacing distance from said guide to the paper web is constant from an inlet roller of said former to an exit lip of said former.

10. The device of claim 1 wherein said transverse cutting device includes a cutter cylinder.

11. The device of claim 1 wherein said transverse cutting device includes a cylinder with a holding system.

12. The device of claim 1 wherein said transverse cutting device includes a folding blade cylinder.

13. The device of claim 1 wherein said guide rail extends through a gap formed by a cutter cylinder and a folding blade cylinder on said transverse cutting device.

14. The device of claim 1 further including a paper web leading end clipping device before, in said direction of web travel, said transverse cutting device.

15. The device of claim 14 further including said inlet to said transverse cutting device being arranged in said direction of web travel after said clipping device.

16. The device of claim 15 wherein said inlet to said transverse cutting device is positioned vertically beneath said clipping device.

17. The device of claim 15 wherein said guide rail has a curved section located between said clipping device and said inlet to said transverse cutting device, said guide rail curved section extending past said inlet of said transverse cutting device.

18. The device of claim 1 further including a holding element storage device located at an extension of said guide rail and after said former.

19. The device of claim 18 wherein said storage device is one of a spiral-shaped and a helix-shaped rail element.

20. The device of claim 18 further including a separating device usable to separate web leading ends from said holding devices and located before, in said direction of web travel, said storage device.

21. The device of claim 20 wherein said guide rail includes a curved section intermediate said separating device and said storage device.

22. The device of claim 1 further including a roll changer located before, in said direction of web travel, said web folding apparatus and wherein said guide rail extends continuously from said roll changer into said folding apparatus.

23. The device of claim 22 further including at least two roll changers and wherein a separate of one said guide rails extends from each of said at least two roll changers.

24. The device of claim 1 further including a plurality of web travel routes, each of said plurality of web travel routes being usable to conduct a paper web through said superstructure to said transverse cutting device.

25. The device of claim 24 further including several guide elements, which each extend along one of said routes, each of said several guide elements joining said guide rail before, in said direction of web travel, said transverse cutting device.

26. The device of claim 25 wherein said several guide elements join said guide rail after, in said direction of web travel, said at least one former at junction points.

27. The device of claim 26 further including a shunt at each junction point of one of said guide elements and said guide rail.

28. The device of claim 26 further including a glue-preparation device arranged on at least one of said routes before, in said direction of web travel, a respective one of said junction points.

29. The device of claim 28 wherein each said glue-preparation device is one of an adhesive tape dispenser and a glue dispenser.

30. The device of claim 29 further including a web start sensor assigned to each said glue-preparation device.

31. The device of claim 1 further including a finite length chain in said at least one guide rail.

32. The device of claim 31 wherein said finite length chain adapted to be curved transversely to said direction of web travel.

33. The device of claim 32 wherein said finite length chain includes chain rollers having longitudinal axes and further wherein an extension of said longitudinal axes intersect at a point defining a radius of curvature of less than 1000 mm.

34. The device of claim 1 further including a plurality of said formers and a separate one of said guide rails being conducted past each one of said plurality of formers.

35. The device of claim 34 wherein first and second ones of said formers are arranged adjacent each other and further wherein a first guide rail is arranged on a first side of said first former and a second guide rail is arranged on a second side of said second former.

36. The device of claim 35 wherein said first side of said first former and said second side of said second former are not adjacent each other.

37. The device of claim 1 wherein said at least one former has a former side and further wherein said at least one guide rail extends along said former side.

38. The device of claim 37 wherein said former side is inclined at an acute angle with respect to said direction of web travel.

39. The device of claim 37 wherein said guide rail is spaced at a distance from said former side.

40. The device of claim 1 wherein said at least one former has a former lateral edge and further wherein said at least one guide rail extends parallel to said at least one former lateral edge.

41. The device of claim 1 further including a chain element in said at least one guide rail, said chain element being adapted to be curved transversely to said direction of web travel.

42. A method for drawing in at least one web of material including:

providing a roll changer supporting a first web of material;

providing a folding apparatus including a superstructure, at least one former located in a direction of web travel after said superstructure, and a transverse cutting device usable for separating webs of material transported through said superstructure and located at said former, into individual products;

locating said transverse cutting device in said folding apparatus after, in said direction of web travel, said at least one former;

providing a guide rail;

providing displaceable paper web leading end holding devices in said guide rail;

providing at least one twisted guide rail section in said guide rail;

locating said guide rail extending from said roll changer through at least one printing group and through said folding apparatus;

locating said at least one twisted guide rail section adjacent said at least one former in said folding apparatus;

fastening a leading end of a first web of material to one of said holding devices at said roll changer;

using said holding device for transporting said leading end of said first web of material from said roll changer through said at least one printing group, over said at least one former and at least to an inlet to said transverse cutting device; and separating said leading end of said first web from said holding device after transporting said leading end of said first web of material to said transverse cutting device.

43. The method of claim 42 further including providing at least one guide element, joining said at least one guide element to said guide rail at a first junction point, conducting a second web of material to said first junction point along said at least one guide element, joining said second web of material to said first web of material at said junction point and conducting said joined first and second webs of material together to said transverse cutting device.

44. The method of claim 43 further including joining said second web of material to said first web of material after passing said holding device past said junction point.

45. The method of claim 43 further including conducting said first and second webs of material to said transverse cutting device using said guide rail.

46. The method of claim 42 further including providing a web leading end clipping device located before, in said direction of web travel, an inlet to said transverse cutting device, using said clipping device for clipping said leading ends of said webs of materials and directing said clipped leading ends into said inlet to said transverse cutting device.

47. The method of claim 46 further including locating said inlet to said transverse cutting device in alignment with said clipping device.

48. The method of claim 42 further including providing a holding device storage device connected to said guide rail, initially using said storage devices for collecting said holding devices and at the conclusion of a printing process returning said holding devices along said guide rail back to initial positions.

49. The method of claim 42 further including providing a second roll changer, fastening a second web leading end to a second holding device at said second roll changer, and using said second holding device and transporting said second web of material through at least one printing group, over at least one former and through said transverse cutting device, and cutting said second web of material off said second holding device at, in said direction of web travel, at least said inlet to said transverse cutting device to which said first web of material was conducted using said first holding device.

* * * * *